US005519941A

United States Patent [19]

Yusko

[11] Patent Number: 5,519,941

[45] Date of Patent: May 28, 1996

[54] SIGHT FOR FIREARMS

[76] Inventor: Michael C. Yusko, 218 N. Pennsylvania Ave., Morrisville, Pa. 19067

[21] Appl. No.: 358,336

[22] Filed: Dec. 16, 1994

[51] Int. Cl.[6] ..... F41G 1/00; F41G 1/10

[52] U.S. Cl. ..... 33/252; 33/233

[58] Field of Search ..... 33/233, 234, 244, 33/252, 261; 42/100

[56] References Cited

U.S. PATENT DOCUMENTS

| | | | |
|---|---|---|---|
| 358,734 | 3/1887 | Decumbus | 33/244 |
| 1,087,747 | 2/1914 | Evans | 33/233 |
| 1,174,063 | 3/1916 | Coller | 33/233 |
| 2,473,891 | 6/1949 | Lillard | 42/100 |
| 2,927,375 | 5/1957 | Luebkeman | 33/47 |
| 3,495,338 | 2/1970 | Ullman | 33/47 |
| 3,777,380 | 12/1973 | Theodore | 42/1 |
| 3,820,248 | 6/1974 | Hayward | 33/244 |
| 3,861,050 | 1/1975 | Mauro | 33/233 |
| 3,983,634 | 10/1976 | Erickson | 33/244 |
| 4,683,662 | 8/1987 | Kiss, Jr. | 33/233 |
| 4,976,038 | 12/1990 | Nattrass | 33/233 |

FOREIGN PATENT DOCUMENTS

| | | | |
|---|---|---|---|
| 342645 | 9/1904 | France | 33/233 |
| 262402 | 7/1913 | Germany | 33/233 |

OTHER PUBLICATIONS

Magazine advertisement, in the Mar./Apr. 1993 issue of 'American Handgunner', of 'Trijicon' brand night sight.

Magazine Advertisement of 'Pachmayr' brand handgun sight. (no date).

Basic Pistol Markmanship Guide by the U.S. Army Markmanship Unit, pp. 7–8 back and and front cover (1983).

*Primary Examiner*—William A. Cuchlinski, Jr.
*Assistant Examiner*—G. Bradley Bennett
*Attorney, Agent, or Firm*—Eckert Seamans Cherin & Mellott

[57] ABSTRACT

A sight is provided for a weapon or other device requiring manual alignment with a target along a viewing line, the weapon having a barrel with front and rear sights. The sights are structured to provide sufficient visual cues to the shooter to enable effective aiming while focusing on the target rather than the sight. The rear sight closer to the shooter has a standing planar member perpendicular to the gun barrel. The rear sight has a rounded outer periphery and a substantially circular central opening joined to the top edge of the rear sight along a discontinuous edge forming rounded wings, and corresponding to a tangent of the circular opening. The front sight has a solid cylinder whose axis is parallel to the axis of the gun barrel. The front sight cylinder is dimensioned relative to the rear sight opening to substantially fill the rear sight opening when the shooter's view is aligned along the barrel to the target. The cylinder can have a vertical longitudinal slit that passes light when the shooter's view is parallel to the axis. The slit in the cylinder and any opening between the cylinder and the rear sight opening provide visual indicators of proper aim. The slit appears to the shooter as a line under the target. When properly aimed, no or little light passes around the cylinder through the circular opening. When improperly aimed, a laterally asymmetrical arc of light is visible, having a diameter substantially equal to the diameter of the cylinder, which is visible to the shooter while focusing on the target and helps to readily correct aim.

14 Claims, 3 Drawing Sheets

SIGHT FOR FIREARMS

BACKGROUND OF THE INVENTION

1. Field of the Invention

The invention relates to the field of sights for manually aiming articles such as projectile weapons, especially handguns, rifles and similar firearms. The invention is also useful for other aiming functions involving sighting along two alignable elements or sights that are attached to an article and spaced from one another to permit manual alignment of the article to a desired orientation by aligning the spaced sights along viewing line to a target. The invention provides an improved sighting system which permits the user to focus primarily on the target as opposed to focusing on the sights, in that the sights are structured to produce certain visual cues that the user can perceive even while focusing on a point beyond the sights and thus allowing his or her view of the sights to become somewhat blurred.

2. Description of the Related Art

A variety of sighting devices are known for orienting devices that need to be aimed. Although the present invention is applicable to various such situations, it will be discussed primarily with respect to the problem of aiming firearms and similar weapons. Firearms and the like typically have two sights that are spaced from one another along a line substantially parallel to the path along which a projectile will be discharged by the weapon. A user holds the firearm manually so as to view over and/or through the two spaced sights toward the target, before discharging the weapon. Adjustments can be made mechanically on the sight or manually by the user, to adjust for windage and elevation. In any event the object is to align the weapon accurately to the target by viewing along a line to the target and holding the weapon along that line as defined by the spaced sights.

The state of the art of present day sights includes the open or "iron" sight, the peep sight and the scope. The typical open or iron sight is by far the most commonly used for handguns and rifles. Typically an iron sight has a front sight comprising a blade member at the extreme front or muzzle end of the weapon. The blade member comprises an opaque fin that is usually rectangular in cross section and appears to the user as a thin solid block on the top surface of the barrel in line with a longitudinal axis of the barrel.

The rear sight of an open or iron sight is disposed at the rear of the weapon, and typically comprises a planar member having an open rectangular notch extending downward from a horizontal edge at the top periphery of the planar member. The rear sight can be along the barrel or over the chamber portion of the weapon, proximate to the shooter. To aim the weapon, a shooter aligns the front sight blade with the rear sight notch. The weapon is adjusted as to elevation by setting the top edge of the front sight blade even with the top of the rear sight notch. The weapon is aligned laterally by centering the blade in the notch. The intended target should appear just against the top of the front blade. The front and rear sights are dimensioned to place the discharged projectile on the target viewed in this manner at a certain range, provided the correct sight alignment is achieved.

The rear sight is closer to the shooter than the front sight, and the target is typically a substantially greater distance away. Thus it is necessary for the shooter to choose where to focus his or her eyes. If the shooter focuses on the target, the sights will appear blurred. If the shooter focuses on the sights, the target will appear blurred. To some extent, the same problem is encountered as to whether to focus on the front sight blade or rear sight notch; however, the difference in distance from the shooter's eye to the respective sights is less than the difference from either sight to the target, especially, for example, if the sights are on a handgun held at arm's length.

Shooters can shift their focus between the sights and the target, but are taught to focus on the sights when discharging the weapon, rather than upon the target. See, for example, Basic Pistol Marksmanship Guide, US Army Marksmanship Unit (ST 23-35-2 FY 83), page 8. This is considered necessary because focusing on the sights makes it possible for the shooter to see more clearly the centering of the front sight blade in the rear sight notch and the alignment of the top edge of the blade to the top edge of the notch. The weapon is aimed generally correctly even if the target is not in focus. In comparison, if the sights are misaligned, the shooter will not accurately hit the target even if the target can be seen clearly.

Because of these limitations imposed by prior art open or iron sights, such sights are generally accurate only for targets up to a range at which the target still can be seen when focusing locally, for example up to 25 meters. After about 50 meters, accuracy declines rapidly with open sights, because the view of the target is degraded.

What is needed is a structure that relieves the need to choose whether to focus on the target or on the sights. Telescopic sights are helpful for longer distances in that cross hairs not unlike the blade and notch of an open sight can be arranged optically to appear in focus when viewing a target through the sight. However, telescopic sights are expensive and vulnerable to damage.

Various sighting devices have been proposed for improving the accuracy of open gun sights, which are inherently more durable and inexpensive than the typical scope. For example, U.S. Pat. No. 4,683,662—Kiss, Jr. discloses sighting attachments for pistols which clip on the existing front and rear sights of the pistol. The front sight attachment includes a metal clip which clips to the front sight and holds a series of interchangeable sighting pins having varying diameters and colors. Kiss further discloses a rear sighting attachment which clips on the rear blade sight and includes sight inserts each forming a generally circular sight with a sector of about 60°–140° removed from the top of each sight insert. When aiming, the center of the circular of the rear sight insert and the front sight pin are aligned parallel to the sighting and firing line of pistol.

U.S. Pat. No. 2,927,375—Luebkeman further discloses disposing a bead or rounded ball at the end of a barrel of a gun as a front sight and a rear "notch" sight which may be rounded, instead of rectangular.

U.S. Pat. No. 4,976,038—Mattrass discloses a sighting system for a shotgun, including a front "bead" sight member (FIG. 4).

U.S. Pat. No. 1,087,747—Evans discloses a sight intended to provide for better accuracy in elevation and lateral line accuracy for game shooting. Evans discloses a substantially rectangular front gun sight having a notch or vertical slot in the center. The shooter looks through the slot to the target. The slot is defined in a thin wall resembling the notch of a conventional rear sight, and appears to extend slightly below the bottom of the rear sight when properly aimed.

An elongated slot sight is disclosed in U.S. Pat. No. 3,777,380—Theodore. Elongated slot sights, like blade-and-notch sights, require the user to align front and rear structures. With a slot, failure to align the weapon laterally relative to the target causes the slot to appear to close. It is difficult with a slot for the user to distinguish between a slot which is almost in alignment with one that is correctly in alignment, because the difference is perceived as a difference in the slot width. A very long and narrow slot is "closed" visually more easily than a wider one. Theodore has a tapering slot with contrasting colors for the slot walls, in an effort to improve its usefulness. Nevertheless, as apparent from FIGS. 5*a*–5*e* of Theodore, the user is required as a practical matter to view and focus upon the sight more than the target.

U.S. Pat. No. 3,983,634—Erickson discloses a sunshade mountable on the forward end of the rear sight of a rear peep sight of a rifle. The sunshade prevents light shining on the forward bead sight from overwhelming a shooters view of the target.

U.S. Pat. No. 1,174,063—Frank discloses any elongated front sight having a body terminating in upwardly extending wing sections and a bottom radius. A sighting bead 8 is secured within the channel defined by the upwardly extending wing sections and bottom radius.

The prior art includes a number of variations for open sights. However, the shooter typically must focus upon the sights to determine accurate alignment. What is needed is a sight structure that provides visual cues to the shooter indicating sight alignment, that rely less for accuracy on focusing on the sight, and therefore permit the user to focus more on the target.

SUMMARY OF THE INVENTION

An object of the invention is to provide an improved aiming system structure for sighting to a target, especially for weapons such as handguns, rifles and shotguns.

It is another object of the invention to provide improved open sights which enable faster and more accurate aiming and/or effective aiming for targets at a greater range.

It is a further object of the invention to provide gun sights which enable a shooter to focus his vision substantially exclusively on the target rather than the gun sights, while nevertheless providing effective visual cues to the shooter indicating the state of alignment of the sights.

These and other objects are satisfied according to the invention, which provides a novel design for front and rear open sights, arranged to cooperate with one another to provide visual cues of light and dark indicating alignment of the sights.

The rear sight of the invention can be located further up the barrel from the shooter as compared to a conventional rear sight, i.e., the front and rear sights can be closer together than usual. The rear sight of the invention essentially is defined by an upstanding planar member disposed perpendicular to the longitudinal axis of the gun barrel. The rear sight has a rounded top periphery to eliminate straight lines and comers which tend to attract attention, invite focusing on the sights and therefore to divert a shooter's attention from the target. A substantially circular opening is disposed substantially in the center of the rear sight and is open and discontinuous at its top center, a tangent of the circular opening corresponding to a horizontal upper edge of the rear sight. Thus the circular opening is arranged between rounded surfaces and edges, and is not completely bordered around 360° by the planar member. Preferably, however, the planar member borders the opening by more than 180°.

The front sight comprises an opaque cylinder, e.g. a solid cylinder, having a longitudinal axis parallel to the longitudinal axis of the barrel. The cylinder has a vertically oriented slit along its entire longitudinal length. The slit opens at the top of the cylinder and extends nearly to the bottom of the cylinder.

In operation, a shooter spots his target and raises the weapon to a general shooting position, substantially at arm's length. As when using a typical notch and blade open sight, the front sight is placed so that the target appears to sit on its top and the front and rear sights are aligned along the shooter's line of view. The top of the slit in the cylinder is positioned to touch the bottom of the target in the shooter's view, and the cylinder is centered in the circular opening of the rear sight.

The sizes of the cylinder of the front sight and the circular opening of the rear sight are chosen such that the cylinder and circular opening appear equal due to their respective distances from the eye of the shooter (i.e., more distant shapes appear relatively smaller than the same shape closer to the shooter). The periphery of the cylindrical front sight appears to the shooter to substantially completely fill the boundaries defined by the opening in the rear sight, leaving at most a very narrow annulus between the cylinder and the openings of the edges. Additionally, a tube can be arranged to surround the front sight cylinder, to enhance the presentation to the shooter, which is an alignment of circles with a central bright slot when the sight is aligned.

This arrangement of the sights minimizes the extent to which the shooter must focus on the sights. When looking through the sights toward a lighter colored target than the opaque sight structures, any misalignment of the front and rear sights is signalled to the shooter by the light that does or does not pass around the cylinder and/or through the slot. The shooter can manipulate the firearm readily until a vertical line appears through the slot and the light passing on either side of the cylinder is equal. Whereas these light cues are distinctively shaped, they can be seen without focusing on the sights while making the minor movements needed to maintain alignment, as shown by minimal or no light passing around the cylinder and a visible vertical strip appearing under the target. The shooter can focus upon the target while aiming the gun without substantially reducing the alignment effectiveness of the sights.

In a preferred embodiment, a generally cylindrical tube or hood having an inside diameter somewhat greater than the outside diameter of the cylindrical front gun sight is placed over the front gun sight. The cylindrical tube or hood essentially covers the entire from cylindrical sight. The from of the cylindrical sight, towards the muzzle of the gun, can extend slightly out of the hood. The hood preferably extends over the rear of the front sight.

The hood blocks out the undesirable affects of ambient light along the top and rear of the cylinder, and assists in aiming accuracy by providing a circular border within which the target must be confined. The hood further serves to protect the cylinder from impact. Insofar as the front of the cylinder extends forward beyond the hood, such front of the cylinder is illuminated and assists in bringing the firearm down toward an angle aligned to the target.

The sight of the invention meets the objectives of providing an open sight which is easy to aim and highly accurate. A substantial advantage is that the shooter obtains effective visual clues from the sight while focusing on the target rather than the sight, due to the partly circular area of light that passes the cylinder when the front and rear sights are not aligned between the shooter's eye and the target.

When using conventional notch and blade type open sights, it is necessary for the shooter to focus on the notch and blade to ensure accurate alignment. The gun sights of the invention take advantage of the ability of the eye and the mind to perceive a light pattern having certain aspects of size and shape, without actually focusing on the light. It only is necessary for the shooter to focus on the target and align the front and rear sights to eliminate the appearance of crescent shaped beams of light which appear around the cylinder when the sights are improperly aligned.

These and other objects and advantages of the invention will become apparent in connection with the following description of certain preferred embodiments of the invention and the accompanying diagrams.

BRIEF DESCRIPTION OF THE DRAWINGS

There are shown in the drawings examples of embodiments of the invention as presently preferred. It should be understood that the invention is not limited to the precise arrangements and instrumentalities shown in the drawing, wherein.

DETAILED DESCRIPTION OF THE PREFERRED EMBODIMENTS

Figures 1, 2:
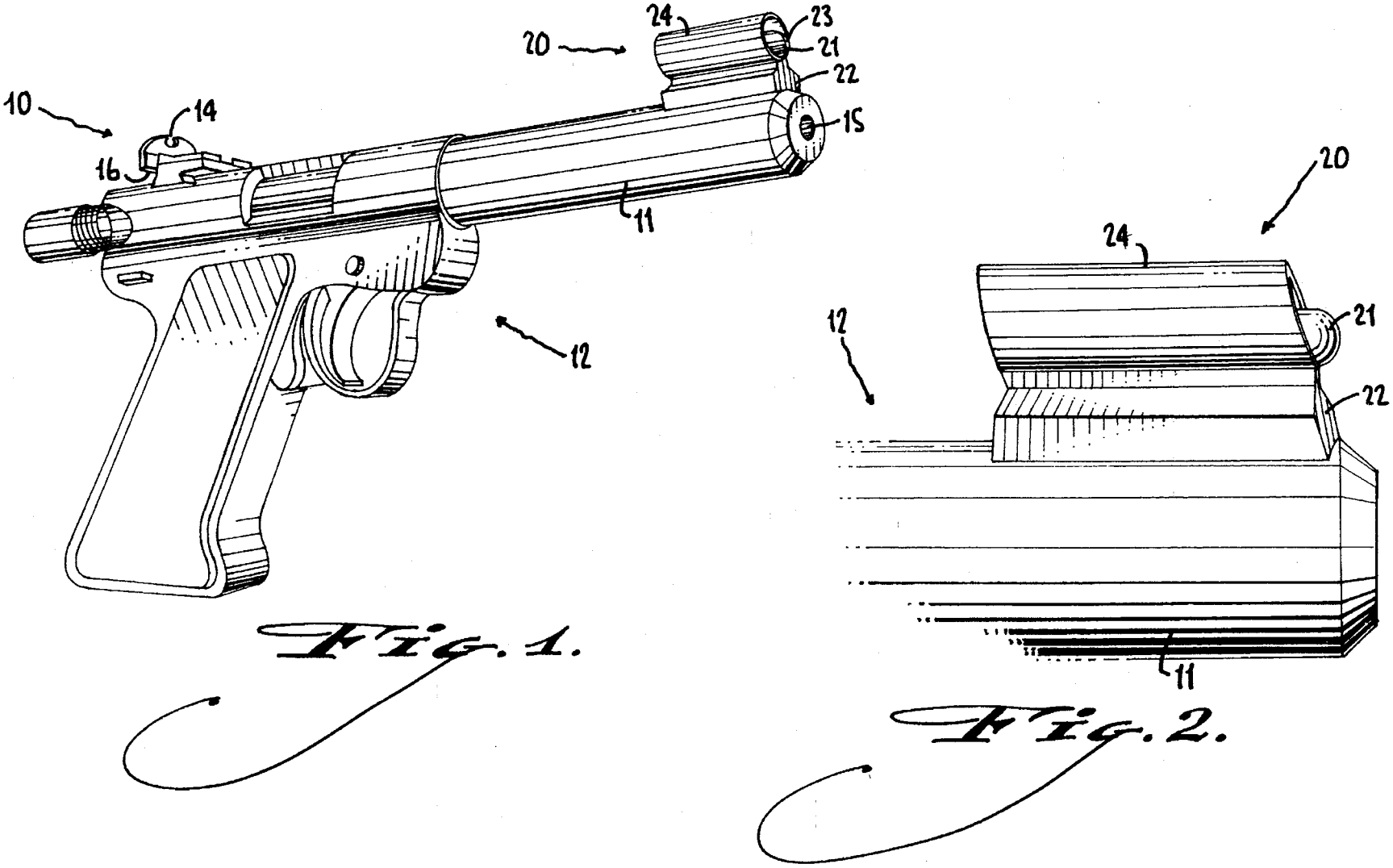
FIG. 1 is a perspective view of the invention mounted, for example, on a handgun.
FIG. 2 is an elevated side view of the front sight of FIG. 1.

FIG. 1 generally shows a preferred embodiment of the sighting structure of the invention, shown mounted on a firearm. The sights are also applicable to other aiming situations in which an article is manually aimed by a user at a target.

The sighting system generally includes rear sight 10 and front sight 20. Rear sight 10 comprises a typically planar member disposed in an upright position perpendicular to a longitudinal axis of barrel 11 of a handgun 12 or other aimable device. Such aimable devices may include other types of projectile launching systems having an elongated barrel, such as rifles, blowguns, artillery pieces and the like, as well as non-projectile devices such as optical and radar sighting directional and/or range-finding means, etc.

In the example shown, rear sight 10 is disposed near the end of barrel 11, proximate to the shooter, who operates the weapon in a conventional manner from a standing, prone, kneeling, sitting or other position, for example, holding the weapon at arm's length along a line of sight to the target. The distance between rear sight 10 and front sight 20 can be varied according to preferences of the shooter, and it has been determined through experimentation that rear sight 10 can be placed relatively closer to front sight 20 as compared to prior an open sights. Rear sight 10 has opening 14 which will be discussed in detail hereinafter.

Figure 3:
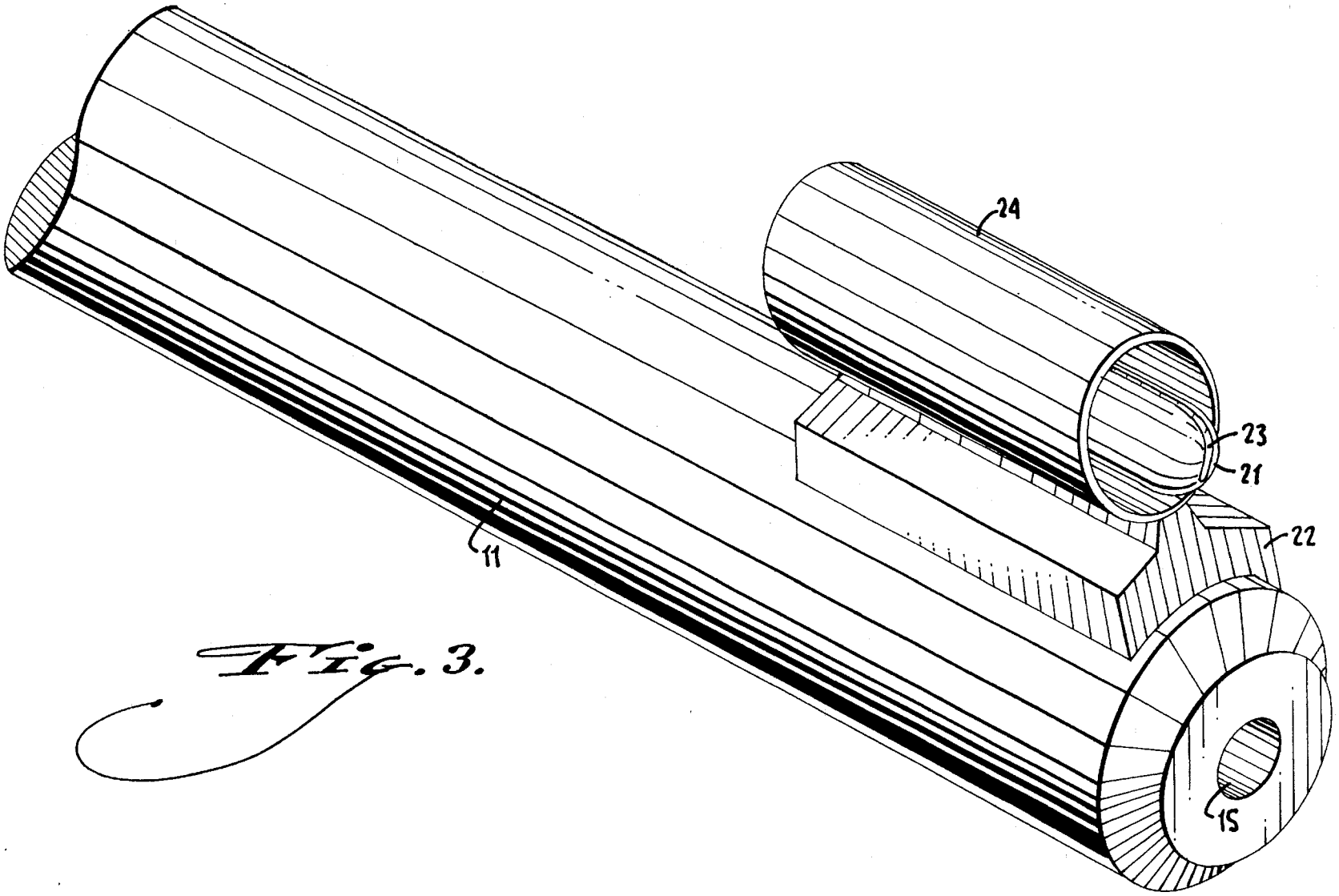
FIG. 3 is a partial front perspective view of the front sight on the barrel of a firearm.

With additional reference to FIGS. 2 and 3, front sight 20 includes an elongated cylinder or bead structure 21. Bead 21 is attached to mounting member 22 near muzzle opening 15 of barrel 11. Cylinder or bead 21 has a longitudinal axis parallel to the longitudinal axis of barrel 11, which defines the discharge path of the projectile (not shown). A bead slit 23 has parallel closely spaced walls and extends the entire longitudinal length of cylindrical bead 21. Slit 23 also extends from a top of cylindrical bead 21, which can be slightly flattened, to nearly the bottom of the bead, and provides a path along which light from the direction of the target can pass to the eye of the shooter.

Cylindrical bead 21 preferably is covered by hood 24. Hood 24 has an internal diameter somewhat larger than an external diameter of cylindrical bead 21. Hood 24 extends substantially an entire length of cylindrical bead 21; however in a preferred embodiment the front end of cylindrical bead 21 extends slightly beyond the front edge or opening of hood 24 as illustrated in FIGS. 2 and 3, and at the rear hood 24 extends beyond the rear of cylinder 21 and thus shades it.

Figure 4:
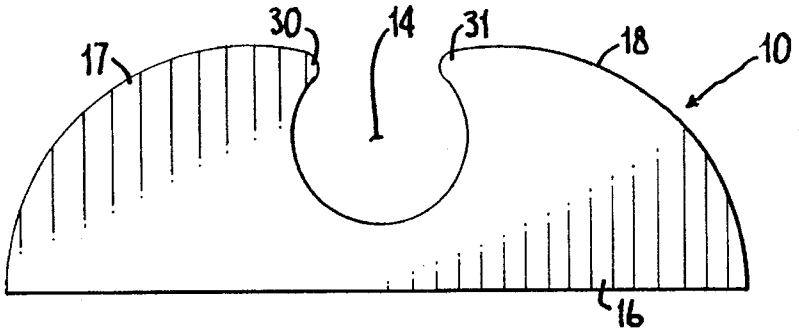
FIG. 4 is a rear elevated view of a preferred embodiment of the rear sight of the invention.

FIG. 4 is a rear view of rear sight 10, i.e., from the perspective of the shooter. Rear sight 10 has a substantially horizontal bottom 16 and left and right radial rear sight peripheries 17 and 18, respectively. Left and right rear sight peripheries 17 and 18 define sight opening 14. Sight opening 14 is generally circular, having an upper tangent shared with a discontinuity at the top of rear sight 10. Left and right radial rear sight peripheries 17 and 18 preferably terminate in wings 30 and 31, which partially extend over the tangential opening of sight opening 14 and can be rounded. Rounding of the peripheries 17, 18, as well as a slight flattening of the top surface of cylinder bead 21 adjacent slit 23 (see FIG. 3), tend to avoid or minimize sharply pointed edges, which otherwise draw the shooter's focus.

Figure 5:
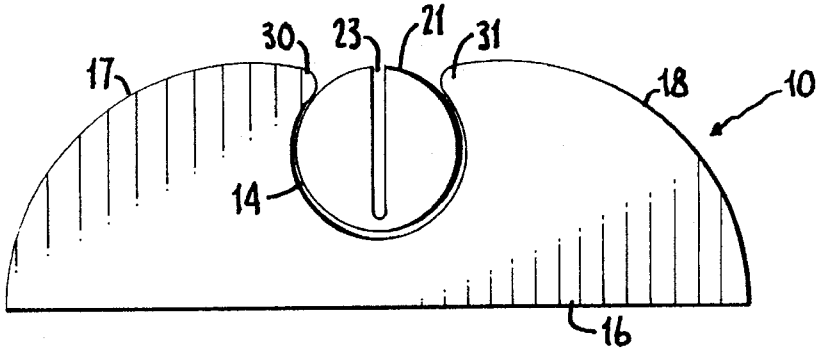
FIG. 5 is a rear elevated view showing the view to the shooter through the rear and front sights of the invention, when properly aimed.

A view through rear and front sights 10 and 20 when the firearm or other projectile launching piece is properly aimed is shown in FIG. 5. When the weapon is properly aligned, cylindrical bead 21 appears as a substantially circular cross-section evenly residing in sight opening 14 of rear sight 10.

Virtually no light or very little light is apparent when the aim is accurate, between the borders defined by the outer diameter of cylindrical bead 21 and inner diameter of sight opening 14. The sights can be dimensioned for shooters of different size or preferred stance, such that the apparent size of cylinder 21 and rear opening 14 are equal at the distance from the eye where the shooter holds the weapon. Should any light appear around cylinder 21, such light is equal on the lateral sides of the cylinder, through the boundary defined by cylindrical bead 21 and sight opening 14.

Although FIG. 5 does not show the target, a shooter manipulates the firearm to achieve the sight images shown in FIG. 5 and such that the bottom of the target appears to rest at the top of cylindrical bead 21. Bead slit 23 allows light to pass through cylindrical bead 21 such that the shooter views a slit or needle of light which terminates at the base of the target. The bead slit 23, therefore, further assists in easy aiming of the gun by providing a beam of light which the shooter will recognize without focusing on the sight, and easily align at the base of the target. Wings 30 and 31 provide for a small amount of overlap of opening 14, making it easier for a shooter to center cylindrical bead 21 within the opening.

Figure 6:
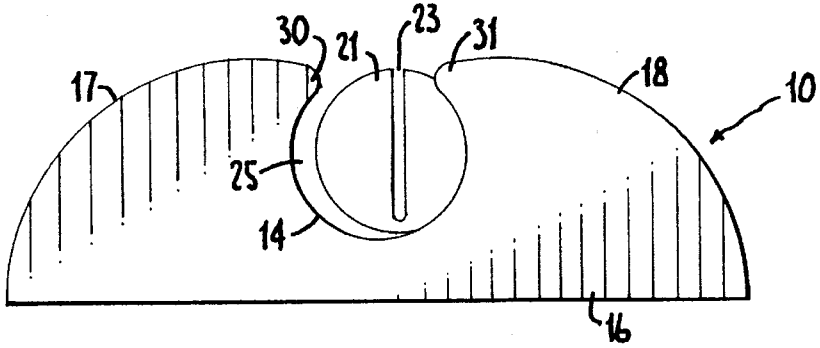
FIG. 6 is a rear view through the rear and front sights when improperly aimed.

It is an aspect of the invention that misalignment of the weapon to the sight path to the target produces a laterally asymmetrical light pattern to the shooter, of a size approaching the diameter of bead 21. This pattern as illustrated in FIG. 6 provides a visual cue to the shooter that can be seen readily without focusing on the sight. Cylindrical bead 21 in FIG. 6 is shown off-center toward the right in the substantially circular sight opening 14, indicating that the weapon is off-line to the right. However, this is apparent to a shooter, who can quickly and easily correct the misalignment of the firearm by repositioning to reduce the asymmetrical light pattern around bead 21 until the large crescent shaped light beam 25 on the left-most side of sight opening 14 is eliminated. No light will be apparent at the right-most side of opening 14 unless the shooter passes center, whereupon a similar pattern appears on the right. Since the mind can perceive this light pattern even when out of focus, aiming can be more readily accomplished while continuing to focus on the target due to the light cues provided. The shooter maintains focus on the target while adjusting the weapon to correct his aim. The crescent shaped light beams on either side are reduced to equal, or preferably eliminated. At this point, assuming also that the base of the target appears squarely atop bead slit 23, the weapon is discharged.

The sighting system as shown and described simplifies the aiming process and reduces the extent to which the shooter's attention is removed from the target. This is preferably accomplished using sight structures having minimal sharp points and edges, which otherwise would tend to attract the shooters attention, while nevertheless generating a relatively large asymmetrical light pattern to indicate improper alignment.

Additional embodiments and variations are possible. These include the use of hood 24 to protect bead 21 and serve as a gross sighting boundary for rapid firing. Hood 21 is arranged to shade bead 21 at the rear, which is visible to the shooter in fine sighting. Bead 21 is not shaded at the from, which is not visible to the shooter in fine sighting, but further assists in gross sighting for rapid firing.

Rear sights 10 having openings of different sizes can be available for fitting the sight to the shooter such that the apparent size of bead 21 and opening 14 are equal for the particular shooter. Additionally, windage and elevation adjustments can be provided in known manner.

The invention has been described with respect to certain preferred embodiments but is subject to variation within the scope of the appended claims. Reference should be made to the following claims rather than the foregoing specification as indicating the true scope of the invention in which exclusive rights are claimed.

What I claim is:

1. A manual sighting system for aiming an article with a barrel defining a longitudinal axis, comprising:

a rear sight having an upstanding member disposed on a rear section of said barrel proximate to a shooter, said rear sight having a discontinuous upper peripheral edge due to a substantially circular sight opening that opens into the upper peripheral edge adjacent a top of the circle; and, a front sight disposed on said barrel, spaced from the rear sight and remote from the shooter, said front sight being generally cylindrical, and having a longitudinal axis parallel to said longitudinal axis of said barrel, the front sight being dimensioned relative to the circular sight opening to fill substantially completely the circular sight opening as viewed by the shooter, leaving at most a narrow annulus between the cylinder and boundaries of the circular sight opening through which light can pass, the annulus being symmetrical when the sights are aligned and varying from symmetrical with misalignment of the sights;

whereby the shooter, while focusing exclusively on a remote target and attempting to align the front and rear sights to center said front sight in said circular sight opening, perceives and is cued by light from the annulus to align the sights to the target while focusing on the target.

2. The sight of claim 1, wherein said front sight is elongated longitudinally and has an open longitudinally disposed slit extending vertically from a top boundary of said front sight, thereby defining an opening in a top of said cylindrical front sight, through which light is perceived by the shooter longitudinally through the slit, provided the shooter views longitudinally through the front sight, the slit blocking light when viewed other than longitudinally.

3. The sights of claim 2, wherein said slit extends from the top boundary of the cylindrical front sight to adjacent a bottom boundary thereof.

4. The sights of claim 1, further comprising an elongated, hollow, cylindrical hood having an inside diameter sufficient for said front sight to reside within, said cylindrical hood having a longitudinal axis parallel to the longitudinal axis of the barrel, said hood substantially covering said front sight.

5. The sights of claim 1, further comprising a mounting member disposed beneath said front sight, for mounting said front sight on said barrel.

6. The sight of claim 1, wherein said rear sight has a substantially rounded upper peripheral boundary where the circular opening meets the upper peripheral edge.

7. The sight of claim 1, wherein said rear sight has opposing wings jutting into a gap formed where the circular opening meets the upper peripheral edge.

8. The sight of claim 1, wherein said rear sight is spaced forward of a rear of said barrel from the shooter.

9. The sight of claim 1, wherein said rear sight is generally planar and is perpendicular to said longitudinal axis of said barrel.

10. The sight of claim 1, wherein said circular opening of the rear sight opens into the upper peripheral edge by no more than 90 degrees of circumference of the circular opening.

11. A method of aiming a weapon having an elongated barrel to be aimed manually by a shooter along a longitudinal axis leading to a target, comprising the steps of:

providing a rear sight having an upstanding member disposed on the barrel proximate to a shooter, said rear sight having a substantially circular sight opening that opens into a top edge of the rear sight to form a partially open circle;

providing a front sight disposed on the barrel at a space from the rear sight and remote from the shooter, said front sight being generally cylindrical, having a longitudinal axis parallel to said longitudinal axis, and the front sight being dimensioned to have an apparent size substantially equal to that of the circular sight opening from a perspective of the shooter, leaving at most a narrow annulus between the front sight and the circular sight opening through which light can pass from the target to the shooter, the annulus being symmetrical when the sights are aligned and varying from symmetrical with misalignment of the sights;

the shooter focusing on the target while viewing through the rear sight and the front sight and manipulating the weapon to obtain a sight picture through said rear sight wherein the target is in focus and as a result the annulus is out of focus, misalignment of the weapon being visible by light passing through the circular sight opening around the front sight, whereby the shooter perceives and is cued by light from the annulus to align the sights to the target while focusing on the target.

12. The method of claim 11, further comprising providing an open, vertical, longitudinally elongated slit through said front sight, extending from a top boundary of said front sight, thereby defining an opening in a top of said cylindrical front sight, and viewing through the slit while aiming, the slit being open or occluded depending on alignment of the shooter and the front and rear sights, and further cueing the shooter to align the sights to the target while focusing on the target.

13. The method of claim 11, further comprising providing an elongated, hollow, cylindrical hood surrounding said front sight to shade at least a rear portion of the front sight.

14. The method of claim 11, further comprising providing an elongated, hollow, cylindrical hood surrounding said front sight, and at least grossly aiming the weapon by viewing along the rear sight to the cylindrical hood.

* * * * *